United States Patent [19]

Harder

[11] Patent Number: 5,048,595

[45] Date of Patent: Sep. 17, 1991

[54] ROTARY REGENERATIVE AIR PREHEATER BASKET SEALING

[75] Inventor: William F. Harder, Wellsville, N.Y.

[73] Assignee: ABB Air Preheater, Inc., Wellsville, N.Y.

[21] Appl. No.: 663,359

[22] Filed: Mar. 4, 1991

[51] Int. Cl.[5] ..... F28D 19/04

[52] U.S. Cl. ..... 165/9; 165/10

[58] Field of Search ..... 165/8, 10, 9

[56] References Cited

U.S. PATENT DOCUMENTS 3,101,778 8/1963 Hazzard et al. ..... 165/10
3,216,486 11/1965 Hall et al. ..... 165/8
3,710,850 1/1973 Kurschner et al. ..... 165/10
3,818,978 6/1974 Finnemore ..... 165/9

*Primary Examiner*—Albert W. Davis, Jr.
*Attorney, Agent, or Firm*—Paul J. Lerner

[57] ABSTRACT

An improved element basket for a rotary air preheater includes at least one imperforate steel sheet, tack welded to the basket exterior, completely covering one side of the basket. A distal edge portion of the sheet is bent back upon itself and is biasable against a wall surface of the air preheater rotor. The side sealing member fills the gaps between the element basket and the adjacent rotor compartment wall, preventing gas or cold air from bypassing the heat transfer elements in the basket.

6 Claims, 2 Drawing Sheets

ROTARY REGENERATIVE AIR PREHEATER BASKET SEALING

BACKGROUND AND SUMMARY OF THE INVENTION

The present invention relates to rotary regenerative heat transfer devices and, more particularly, to air preheaters wherein the individual heat transfer elements are stacked in open baskets which, in turn, are disposed in compartments in the rotor of the transfer device.

Air preheaters utilize the heat that would otherwise be lost out the smoke stacks of industrial and central power station boilers. In the preheater, this waste heat is captured before it reaches the stack and is transferred to the incoming cold air. Thousands of specially formed steel sheets—called heat transfer elements—absorb the waste heat from hot gases flowing through one half of the preheater structure—and release it to the incoming cold air as it passes through the other half of the structure. The heat transfer elements are spaced and arranged in a cylindrical shell called the rotor. The spaces between the elements allow the air and gas streams to flow across the surface of each sheet. The rotor revolves slowly within the preheater structure, carrying the elements alternately through the air and gas streams so that there is a continuous transfer of heat.

As a means of facilitating the efficient removal and replacement of the heat transfer elements in an air preheater, it is the common practice to stack the individual elements in baskets which are inserted into compartments formed in the rotor. To reduce both weight and cost, the element baskets most commonly comprise an open frame, rather than solid walls.

After the heat transfer device has been in service for some time, the diaphragms and stay plates which define the basket-receiving compartments may become distorted by the operating conditions to which they are exposed. To insure that the baskets may be freely inserted and removed from the compartments, despite such distortion, the baskets are generally undersized. Thus, substantial gaps exist between the baskets and the rotor compartment walls. These gaps allow a portion of the gas and air flows to bypass the heat transfer elements, resulting in a loss of thermal efficiency.

It is, therefore, a primary object of the present invention to provide an element basket for an air preheater or similar heat transfer device wherein the gas and air flows are constrained to pass substantially completely over the heat transfer elements.

It is a further object to provide such an element basket which may be readily inserted and removed from a basket-receiving compartment in the rotor.

It is yet another object to provide an element basket as aforesaid which is light in weight and inexpensive to produce.

The foregoing and other objects as may hereinafter appear are achieved by an element basket including at least one side sealing member consisting of an imperforate sheet fastened on the outside of the basket frame and substantially completely covering a side of the basket, a distal edge portion of the sheet being bent back upon itself and biasable against a wall surface of the rotor. The side sealing member fills the gaps between the element basket and the adjacent rotor compartment wall, preventing gas or cold air from bypassing the heat transfer elements in the basket.

DESCRIPTION OF THE PREFERRED EMBODIMENT

A conventional element basket 10 comprises a plurality of heat transfer elements 1 stackingly retained in an open frame 3 so as to provide passage for gas or cold air therebetween.

Figure 2:
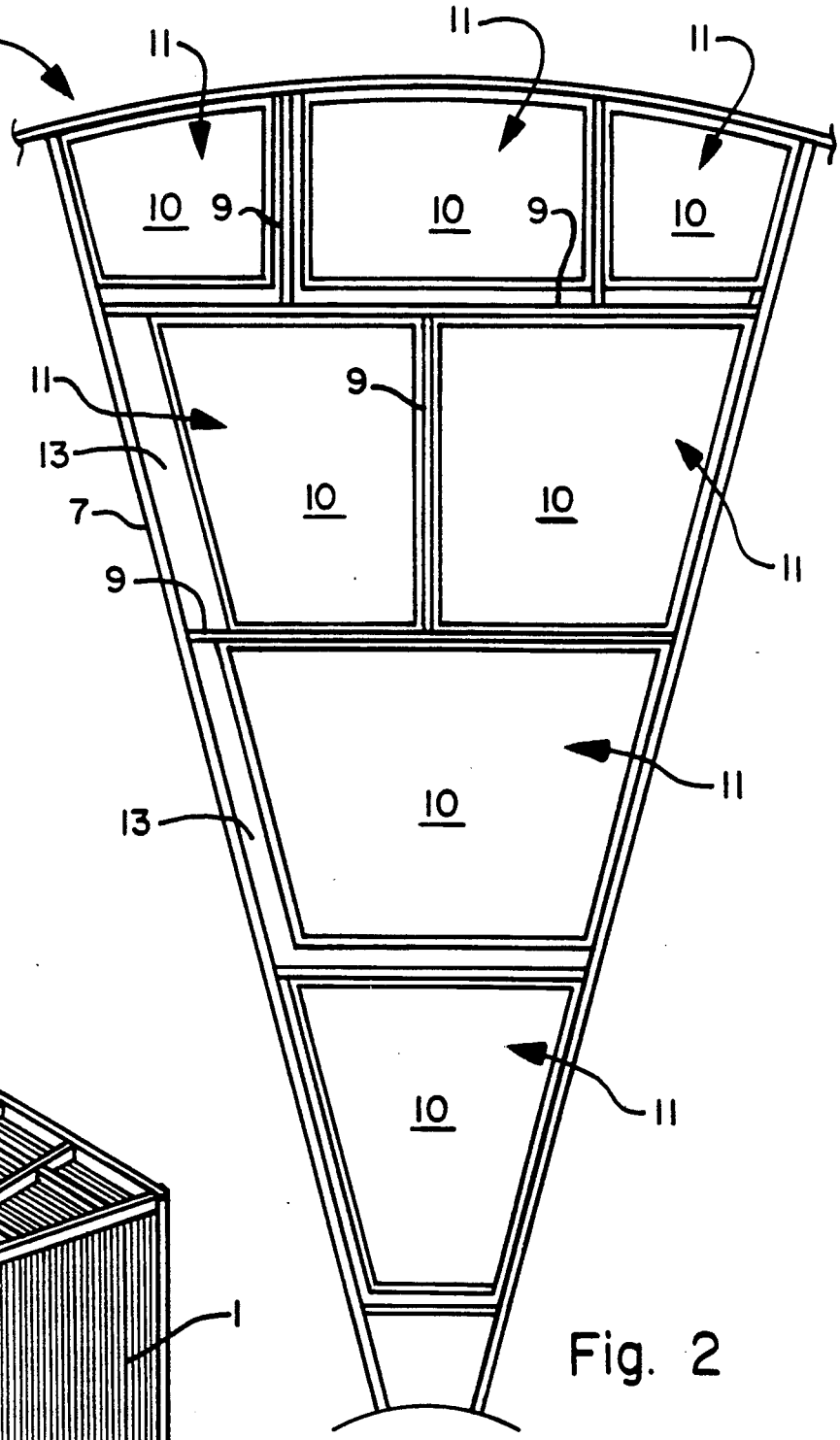
FIG. 2 is a fragmentary top plan view of an air preheater rotor.
Figure 1:
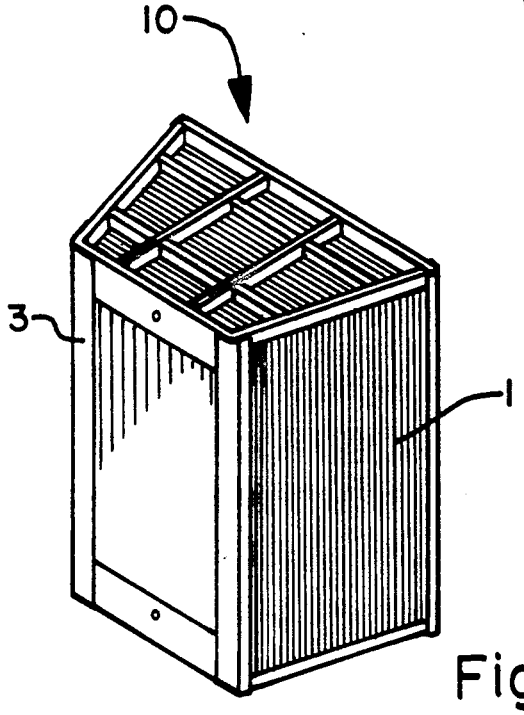
FIG. 1 is a perspective view of a conventional element basket for an air preheater.

There is shown, in FIG. 2, a segment of an air preheater rotor 5. Rotor 5, which in its entirety is cylindrical, is divided by diaphragms 7 and stay plates 9 into a number of compartments 11 each adapted to receive an element basket 10. Element baskets 10 are appreciably smaller than compartments 11 in which they are received, to allow for ready insertion and removal despite distortion of compartment-defining diaphragms 7 and stay plates 9. As a result of this size disparity, there are substantial gaps 13 between baskets 10 and the compartment walls, through which gas or cold air may flow.

To prevent flow through gaps 13, element baskets 10 are provided with at least one side sealing member 15 which consists of an imperforate sheet 17 of thin steel, from 16 to 24 gauge thickness, tack welded to the outside of frame 3, completely covering one side thereof. A distal edge portion 19 of sheet 17 is bent back upon itself so as to be biasable against a wall surface of rotor compartments 11. Edge portion 19 forms an included angle of between about 45° and about 70°, with the body of sheet 17, terminating approximately 1½ inches to 2 inches therefrom. A right-angled flange 21 is provided, opposite distal edge portion 19, to facilitate attachment of side sealing member 15 to frame 3.

Figure 4:
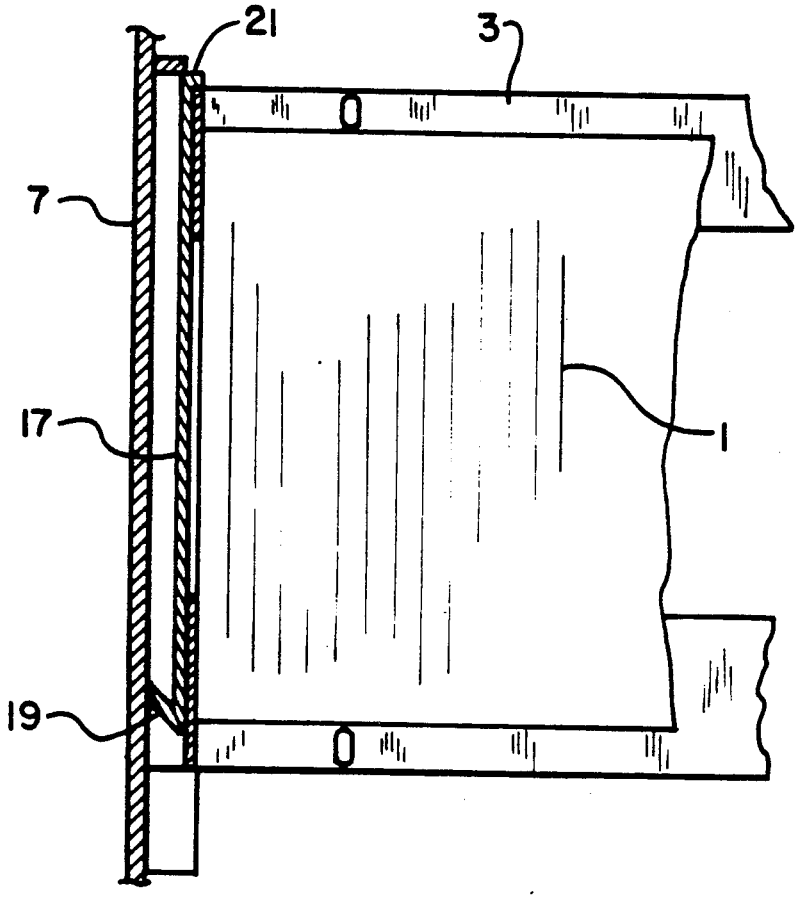
FIG. 4 is a fragmentary cross-sectional view of an element basket, arranged in accord with the present invention, installed in a rotor.
Figure 3:
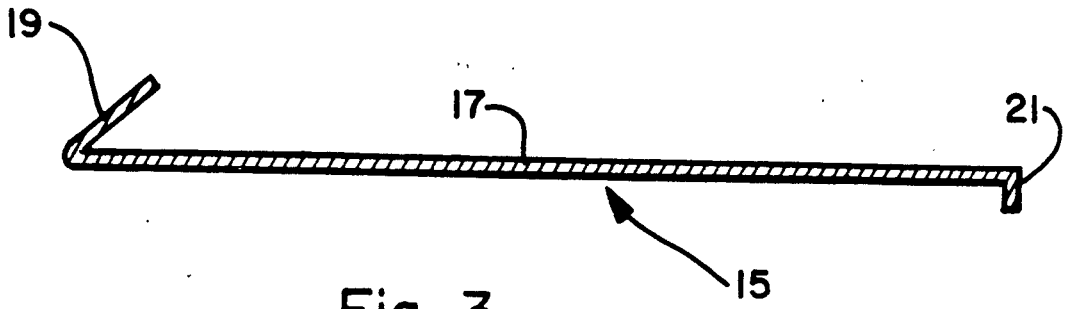
FIG. 3 is a side view of a side sealing member in accord with the present invention.

As best seen in FIG. 4, distal edge portion 19 fills gap 13 between element basket 10 and the adjacent compartment-defining diaphragm 7 or stay plate 9. A side sealing member 15 may be installed on each side of element basket 10 where gap 13 exceeds a predetermined limit. Installation is accomplished by roughly forming edge portion 19 in a pre-cut piece of sheet steel. The roughly formed sheet 17 is then driven between basket 11 and the adjacent compartment wall with a metal bar having an appropriately radiussed nose portion. With sheet 17 in proper position, flange 21 is formed by bending sheet 17 against frame 3, and then tack welded in place.

What is claimed is:

1. An improved element basket for a rotary regenerative heat transfer device comprising a plurality of heat transfer elements;

an open frame for holding said heat transfer elements; and at least one side sealing member, said at least one side sealing member consisting of an imperforate sheet fastened on the outside of said frame and substantially completely covering a first side thereof and including a distal edge portion bent back upon itself and biasable against a wall surface of the heat transfer device.

2. The element basket of claim 1, wherein said sealing member is formed of a sheet of metal of about 16 to about 24 gauge thickness.

3. The element basket of claim 2, wherein said sealing member is welded to said frame.

4. The element basket of claim 1, wherein the included angle between said distal edge portion and the remainder of said side sealing member is between about 45° and about 70°.

5. The element basket of claim 1, wherein said distal edge portion has a length of between about 1½ inches and about 2 inches.

6. The element basket of claim 1, wherein said side sealing member includes a flange portion engaging a second side of said frame.

* * * * *